United States Patent [19]

Boal

[11] 4,223,872

[45] Sep. 23, 1980

[54] WIRE ENGAGER FOR CHAIN LINK FENCE DEVICE AND METHODS OF MAKING AND USING THE SAME

[76] Inventor: Leonard Boal, 15455 Old Jamestown Rd., Florissant, Mo. 63034

[21] Appl. No.: 18,149

[22] Filed: Mar. 7, 1979

[51] Int. Cl.[2] ..... E04H 17/10

[52] U.S. Cl. ..... 256/58; 256/53; 256/48

[58] Field of Search ..... 256/48, 52, 53, 11, 256/58

[56] References Cited

U.S. PATENT DOCUMENTS

| | | | |
|---|---|---|---|
| 200,153 | 2/1878 | Sickles | 256/53 |
| 536,956 | 4/1895 | Jones et al. | 256/52 |
| 704,073 | 7/1902 | Mole | 256/53 |
| 1,280,355 | 10/1918 | Zimmerman | 256/53 |
| 3,248,089 | 4/1966 | Barney | 256/48 |

*Primary Examiner*—Andrew V. Kundrat

[57] ABSTRACT

The present invention relates to a wire engager for use with chain link fence wherein a hollow cylindrical member is provided with a plurality of Z shaped apertures in the wall of the cylinder.

1 Claim, 1 Drawing Figure

WIRE ENGAGER FOR CHAIN LINK FENCE DEVICE AND METHODS OF MAKING AND USING THE SAME

BACKGROUND OF THE INVENTION

Conventional techniques in general use for stringing barbed wire and the like near the top of chain link fence consist of elongated members with notches. These members are generally very large, bulky, and expensive to manufacture.

SUMMARY

It is therefore an object of the present invention to provide a wire engager device which in general comprises a hollow cylindrical member provided with a plurality of Z shaped apertures.

An object of the present invention is to provide such a device which may be used in separate form attached to fence post or may be made integral with the fence post.

A further object of the present invention is to provide such a device which is simply and economically manufactured and used.

These together with other objects and advantages which will become subsequently apparent, reside in the details and construction and operation as more fully hereinafter described and claimed, reference being had to the accompanying drawings forming a part hereof, wherein like numerals refer to like parts throughout, and in which;

DETAILED DESCRIPTION OF THE INVENTION

Figure 1:
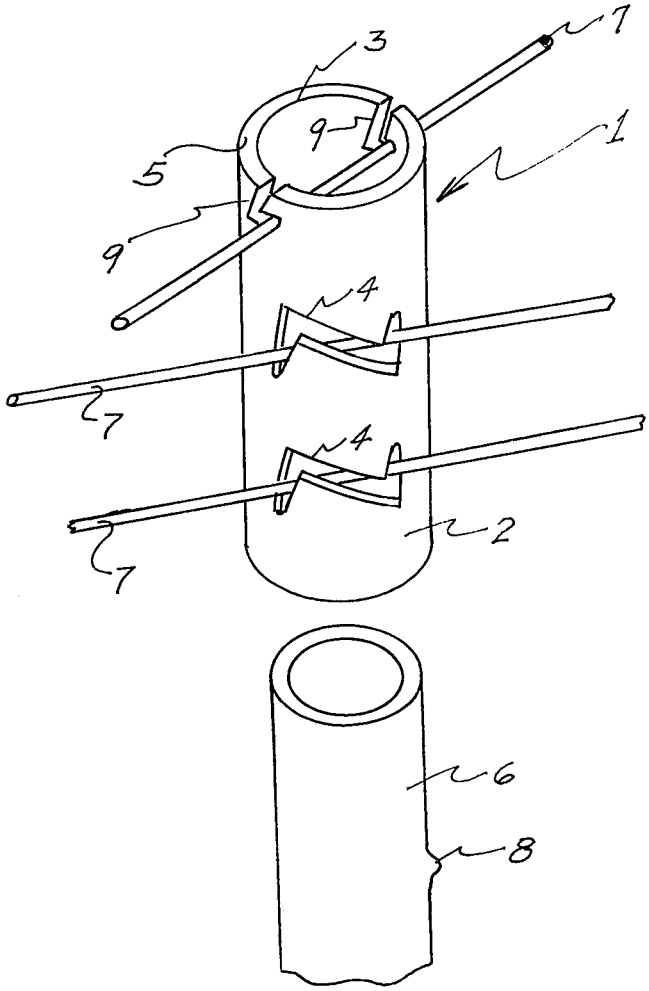
FIG. 1 is a perspective view of a wire engager device constructed in accordance with and embodying the present invention.

Referring now in more detail and by reference characters to the drawings which illustrate practical embodiments of the present invention, FIG. 1, is a perspective view of a wire engager 1, constructed in accordance with, used in and embodying the present invention.

As shown in FIG. 1, wire engager device 1, comprises hollow cylindrical member 2, provided with chamber 3, therein, and Z shaped apertures 4, provided in the wall thereof. Apertures 4, extend the total thickness of the wall 5, of the cylindrical member 2. Device 1, may be a separate unit as shown or may be formed integral with fence post 6. When device 1, is in place, wires 7, are inserted in slots 4, wherein they are retained. When device 1, is provided separate from post 6, then obstruction 8, is provided on the exterior surface of post 6, to maintain device 1, at the desired altitude. Further, as shown in FIG. 1, device 1, may be provided with apertures 9, which engages another wire 7.

It should be understood that changes and modifications in the form, construction, arrangement, and combination of the wire engager device and methods of making and using the same may be made and substituted for those herein shown and described without departing from the nature and principle of my invention.

Having thus described my invention, what I claim is new and desire to secure by U.S. Letters Patent is:

1. A wire engager comprising, a hollow elongated cylindrical member, said hollow elongated cylindrical member provided with a plurality of Z shaped apertures in the wall thereof, and said hollow elongated cylindrical member provided with corresponding L shaped apertures in the wall thereof and at one end thereof and communicating with the exterior of such end.

* * * * *